US005688143A

United States Patent [19]

McHugh et al.

[11] Patent Number: 5,688,143

[45] Date of Patent: Nov. 18, 1997

[54] ELECTRICAL CONNECTOR FOR USE WITH FLEXIBLE PRINTED CIRCUIT

[75] Inventors: Robert G. McHugh, Evergreen, Colo.; Yu-Ming Hon, Taipei Hsieh, Taiwan

[73] Assignee: Hon Hai Precision Ind. Co., Ltd., Taiwan

[21] Appl. No.: 533,927

[22] Filed: Sep. 26, 1995

[51] Int. Cl.[6] ..... H01R 9/07

[52] U.S. Cl. ..... 439/495; 439/570

[58] Field of Search ..... 459/492–496, 459/566–572

[56] References Cited

U.S. PATENT DOCUMENTS

| | | | |
|---|---|---|---|
| 5,002,494 | 3/1991 | Olsson | 439/493 |
| 5,194,017 | 3/1993 | Consoli | 439/495 |
| 5,213,534 | 5/1993 | Gardner et al. | 439/495 |
| 5,277,621 | 1/1994 | Seto | 439/493 |
| 5,354,214 | 10/1994 | Aso et al. | 439/492 |
| 5,474,468 | 12/1995 | Chishina et al. | 439/495 |
| 5,498,169 | 3/1996 | Ikemoto | 439/495 |
| 5,514,008 | 5/1996 | Kocher et al. | 439/495 |

*Primary Examiner*—Neil Abrams
*Assistant Examiner*—Brian J. Biggi

[57] ABSTRACT

An electrical connector for use with flexible printed circuit (FPC) includes a casing having an interior chamber defined by two side walls and a bottom and having a top opening. The chamber has a plurality of slots formed therein for receiving conductive terminal members having a base from which two opposite arms extend. Each slot has a bottom section for receiving the base of the respective conductive terminal member and a side section defined by a recess formed on each of the side walls to receive therein one of the arms. Each of the arms has an inclined outer edge defining a gap with the side wall of the casing to allow the arms to be bent toward the side walls, forming an increased spacing between the arms for receiving therein the FPC. A shortened central arm, having sideward projected paws, is also provided on the base of the terminal members to be received within a central channel formed on the bottom of the chamber to retain the terminal member within the slot. A driver member having a plate to be inserted into the chamber with a sufficient gap formed between the plate and the side walls of the chamber for receiving and retaining therein the FPC is provided to be movable relative to the casing along an insertion direction to be inserted into the interior chamber.

8 Claims, 7 Drawing Sheets

ELECTRICAL CONNECTOR FOR USE WITH FLEXIBLE PRINTED CIRCUIT

FIELD OF THE INVENTION

The invention relates generally to an electrical connector structure and in particular to an electrical connector for use with a flexible printed circuit (FPC).

BACKGROUND OF THE INVENTION

FPC connector, dependent upon the requirements in use, is classified into three categories, namely horizontal insertion connector with upper side contact region, horizontal insertion connector with lower side contact region and vertical insertion connector. There have been a variety of different designs of FPC connector known, such as those disclosed in U.S. Pat. Nos. 5,078,611; 4,808,113, 4,629,271, 4,684,183 and 3,989,336. All these patents disclose electrical connectors each having an insulation casing defining an interior space in which conductive contact terminal members are received, the contact terminal members each having a resilient engaging arm having a contact provided thereon to contact and establish electrical connection with the FPC. A driver member is provided to move in a linear manner relative to the casing for bringing the FPC into the casing and securing the FPC within the casing to be in electrical engagement with the terminal members. Several disadvantages are found in these known designs of FPC connectors, such as:

(1) In the conventional designs, each of the terminal members has only one contact arm and is arranged so that the FPC is acted upon by the contact arms at only one side thereof which leads in a force imbalance and may cause undesired deformation of the FPC, thus resulting in bad contact engagement between the arms and the FPC. Further, for each contact, only one arm acts upon one side of FPC and has to have sufficient resiliency to accommodate the insertion of the FPC, which results in a more strict requirement for manufacturing tolerance and this in turn increases the cost.

(2) In the conventional designs, the parts of the FPC connectors of different categories are different from each other and this results in an increase of manufacturing cost in making separate molds for preparing parts of connectors of different categories.

It is therefore desirable to provide an FPC connector structure which overcomes the above-mentioned problems.

OBJECTS AND SUMMARY OF THE INVENTION

An object of the present invention is to provide an FPC connector which comprises contact terminal members, each having two opposite resilient arms which, when simultaneously acting upon the driver member and the FPC, provide a balance of force acting upon the FPC and thus establishing a better electrical engagement between the contact terminal members and the FPC.

It is another object of the present invention to provide an FPC connector which comprises contact terminal members each having two opposite resilient arms and each having an inclined outer edge facing the inner surface of the interior chamber formed on the casing so as to form a gap between two opposite arms which provides the capability of elasticity for the arms to accommodate the FPC inserted therebetween and thus less requirement of manufacturing tolerance may be imposed on the contact terminal members in providing suitable resiliency.

It is a further object of the present invention to provide an FPC connector which comprises a plurality of double-armed contact terminal members, each having a contact projection formed on free end of each of the arms to establish electrical engagement with the FPC inserted therein so as to allow the FPC connector to be used as either an upper side horizontal insertion type or a lower side horizonal insertion type, or even a vertical insertion type.

It is a further object of the present invention to provide an FPC connector wherein the driver member is designed to allow the FPC connector to be used as either an upper side horizontal insertion type or a lower side horizonal insertion type, or even a vertical insertion type.

It is a further object of the present invention to provide an FPC connector wherein the driver member is designed to be rotated relative to the casing toward an inclined position so as to form a gap between the driver and the side wall of the casing to allow easy insertion of the FPC, especially when the FPC is used as a lower side horizontal insertion type in which the lower side wall of the casing is usually attached to another printed circuit board or other electrical device and is thus hindering the insertion of the FPC.

To achieve the above objects, in accordance with the present invention, there is provided an electrical connector for use with FPC comprising an elongated casing having an interior chamber defined by two longitudinal side walls, two lateral side walls and a bottom and having a top opening. The chamber has a plurality of equally-spaced slots formed thereon for receiving and retaining therein conductive terminal members, each of the slots comprising a bottom section partially extending into the bottom of the casing and a side section which is defined by a recess formed on an inner surface of the interior chamber to extend from the bottom section to the top side of the casing. Each conductive terminal member has a base to be inserted to the bottom section of the respective slot with two opposite resilient arms each of which has an inclined outer edge, extending therefrom to be received within the corresponding side section of the slot. A shortened central arm, having sideward projected barbs, is also provided on the base of the terminal members to be received within a central channel formed on the bottom of the chamber to retain the terminal member within the slot. The inclined outer edge of each of the arms defines a gap with the side wall of the casing so as to allow the arms to be bent toward the side wall, forming an increased spacing between the corresponding pair of arms for receiving the FPC. A driver member having a plate to be inserted into the chamber with a sufficient gap formed between the plate and one corresponding side wall of the chamber for receiving and retaining therein the FPC, is provided to be movable relative to the casing along an insertion direction to be inserted into the interior chamber. Each of the arms of the terminal members has an inward projection formed on the free end thereof to contact and establish electrical engagement with the FPC so as to allow the FPC incorporating the driver member to be inserted either above or below the driver member.

BRIEF DESCRIPTION OF THE DRAWINGS

Other features and advantages of the present invention will become apparent in the following detailed description of preferred embodiments thereof, which are illustrative only and not limitative to the scope of the present invention, reference being had to the attached drawings, wherein.

DETAILED DESCRIPTION OF THE PREFERRED EMBODIMENT

Figure 1:
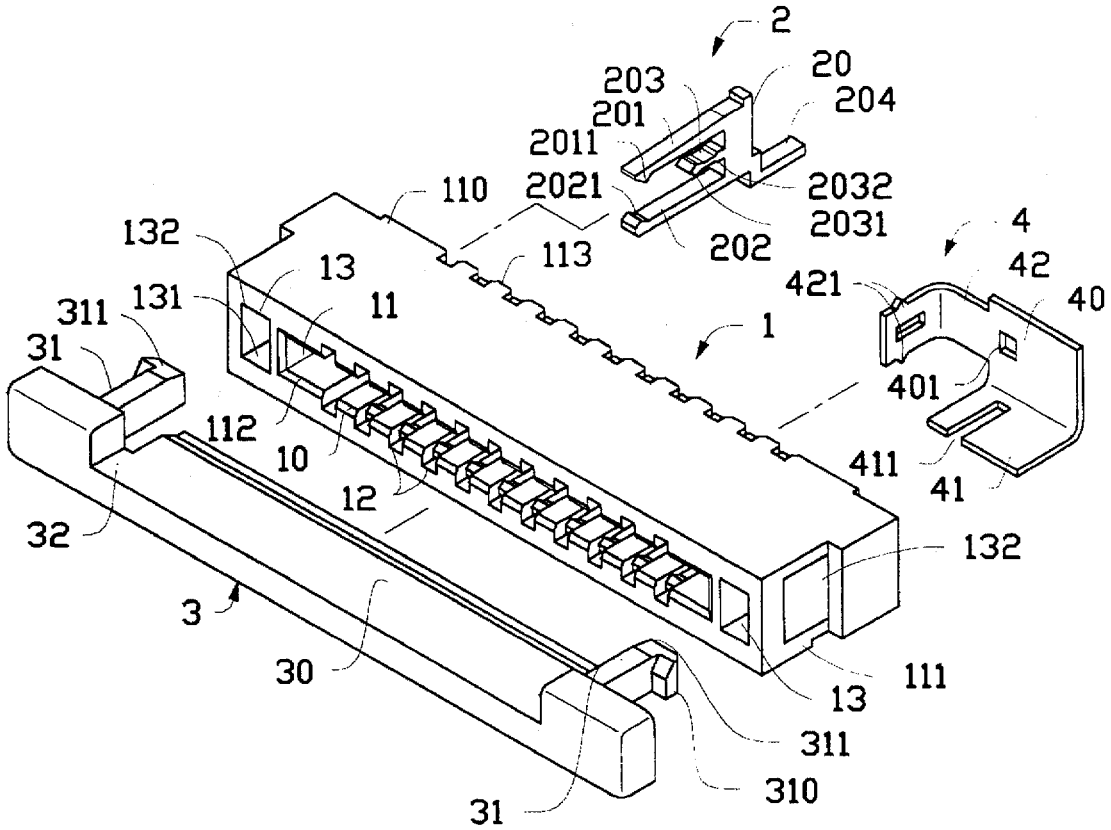
FIG. 1A is an exploded perspective view showing an electrical connector for use with FPC constructed in accordance with a first embodiment of the present invention, which is adapted to be used as an upper side horizontal insertion connector.
FIG. 1B is an end view of the casing of the electrical connector of FIG. 1A.
Figure 1:
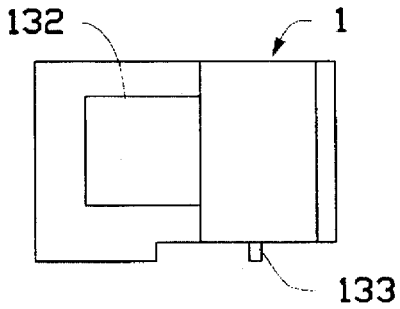

With reference to the drawings and in particular to FIG. 1A, wherein an electrical connector for use with flexible printed circuit (FPC) constructed in accordance with the present invention is shown, the electrical connector in accordance with a first embodiment of the present invention is adapted to be used as an upper side horizontal insertion connector, i.e. the contact region being positioned on the upper side of the connector, comprising an elongated insulation casing 1, a plurality of conductive contact terminal members 2 received within the casing 1, driver means 3 for driving the FPC (not shown) into the casing 1 to be in tight engagement with the terminal members 2 and external mounting means 4 which mounts the electrical connector of the present invention to an external devices (not shown), such as a regular rigid printed circuit board, by means of, for example, soldering to secure the electrical connector to the external device.

In the first embodiment illustrated in FIG. 1A, the casing 1 has formed therein an interior chamber 11 defined by two opposite longitudinal side walls 110 and two opposite lateral side walls 111. The interior chamber 11 has an opening 10 formed on a front side of the casing 1, as viewed in FIG. 1A, for the entry of an FPC and a rear side opposite to the open front side 10, defining a bottom 113 of the interior chamber 11.

The interior chamber 11 has a plurality of slots 12 formed therein and spaced along the length of the casing 1, preferably in an equally spaced manner, to each receive and retain therein one of the terminal members 2. Each of the slots 12 comprises side sections 120 defined by recesses 121 respectively formed on inner surfaces of the two longitudinal side walls 110 and extending to the front side of the casing 1 and a bottom section 122 extending from the rear side of the casing 1 to partially penetrate into the bottom 113 of the interior chamber 11 (see FIG. 3) and in communication with the side sections 120. Each of the slots 12 further comprises a central channel 124 extending from the bottom section, completely through the bottom 113 of the interior chamber 11 to be in communication with the interior chamber 11 and substantially located between the two side sections 120 and preferably in parallel therewith.

On each of two opposite lateral side walls 111 of the casing 1, retaining means 13 is formed, which comprises a receiving hole 131 formed on the front side of the casing 1 and extending toward the rear side of the casing 1 and a retaining hole 132 formed on the lateral side of the casing 1 and extending to communicate with the receiving hole 131. The retaining means 13 will be further discussed in association with the driver means 3.

The casing 1 may also be provided with a mounting pin 133, for example on one of the longitudinal side walls such as the lower one of the longitudinal side walls 110, as shown in FIG. 1B. The purpose of the mounting pin 133 is to provide precise positioning of the electrical connector on the external electrical device, such as a printed circuit board.

As mentioned above, each of the slots 12 receives therein one terminal member 2 which is preferably made of a material of conductivity and elasticity. However, for simplicity, there is only one terminal member 2 shown in FIG. 1A. As shown, the terminal member 2 comprises a base 20 from which a first arm 201 and a second arm 202 extend to be substantially parallel with and opposite to each other to define therebetween a spacing into which the FPC and the driver means are to be inserted. The two arms 201 and 202 are spaced from each other and extending along substantially the same direction, substantially normal to the length of the casing 1 so as to allow the two arms 201 and 202 to be received within the side sections 120 of the respective slot 12 while the base 20 of the terminal member 2 is inserted into the bottom section 122 of the slot 12 from the rear side of the casing 1, as shown in FIG. 3.

The terminal member 2 has formed thereon between the two arms 201 and 202 a central arm 203 which extends from the base 20 of the terminal member 2 to be received within the central channel 124 of the slot 12. The central arm 203 has a length substantially shorter than the first and second arms 201 and 202 to be accommodated within the central channel 124 of the slot 12.

Preferably, the central arm 203 of the terminal member 2 is provided with side barbs 2031 and 2032 to engage inner surface of the central channel for retaining the terminal member 2 within the slot 12.

Figure 3:
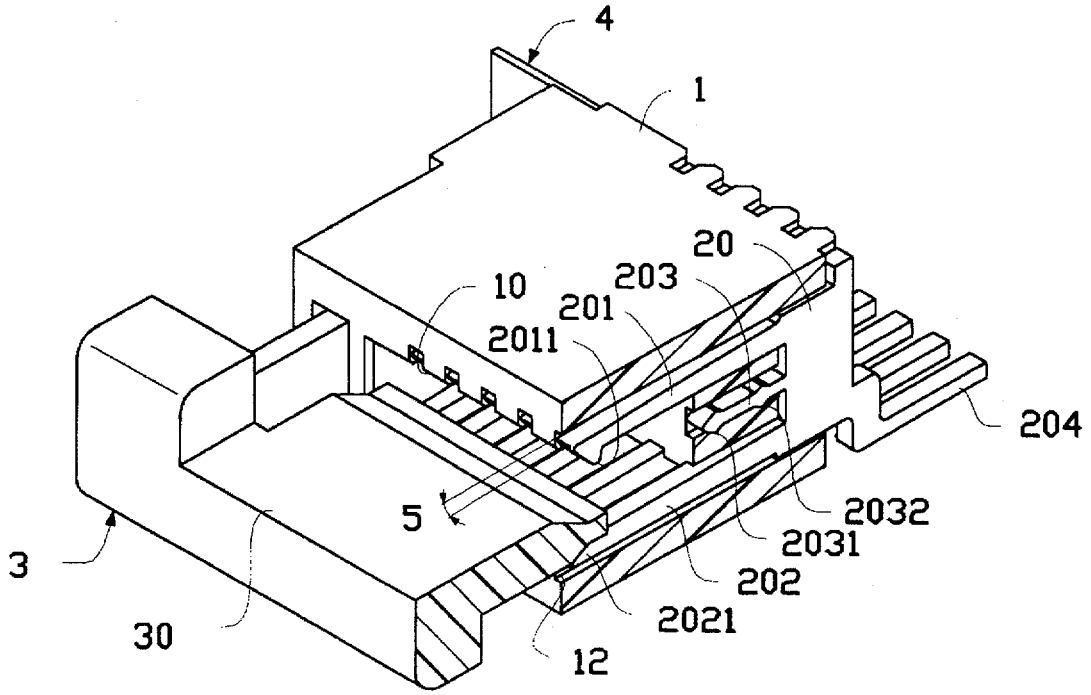
FIGS. 3 is a perspective view of the electrical connector of the first embodiment of the present invention, with a portion thereof cut off to illustrate the inside structure of the electrical connector.

Each of the arms 201 and 202 is provided with an inclined outer edge which is converged inward toward the free end thereof so as to leave gaps 5 respectively between the arms 201, 202 and the corresponding side walls 110, as best seen in FIG. 3. The gaps 5 allow the arms 201 and 202 to be elastically bent outward so as to allow the spacing between the two arms 201 and 202 to be increased for easy entry of the FPC.

An external contact pin 204 is provided on the base 20 of each of the terminal members 2, which in the embodiment illustrated in FIG. 1A, extends substantially along a direction opposite to the arms 201 and 202. Preferably, the external contact pin 204 is mounted integrally associated with the terminal member 2 in an offset manner as shown in the drawings.

Each of the arms 201 and 202 has a contact projection 2011 or 2021 formed on the free end thereof to be substantially flush with or slightly projecting out of the front side of the casing 1. Preferably, each of the contact projections 2011 and 2021 is provided with an inclination for guiding the insertion of the FPC into the chamber 11.

The driver means 3, as shown in FIG. 1A, comprises an elongated plate member 30, preferably having a converging inner end to be insertable into the interior chamber 11 through the opening 10 along an insertion direction from the front side to the rear side of the casing 1 and to be located between the two arms 201 and 202 of the terminal members 2. The plate 30 has such a thickness as to leave a gap between the plate 30 and one corresponding longitudinal side wall 110 of the casing 1 when the plate 30 is inserted into the interior chamber 11 for receiving and sandwiching therebetween the FPC.

The driver means 3 has formed on each of two opposite longitudinal ends a substantial J-shaped engaging member 31 extending substantially parallel with the plate 30 to be each received within one of the receiving holes 131 of the casing 1. The engaging members 31 respectively have hooked ends 310 bent along opposite directions, namely each toward the lateral side walls 111 of the casing 1, to be received within the respective retaining hole 132 for preventing the driver member 3 from fully detaching from the casing 1.

The retaining holes 132 have such a dimension along the insertion direction to allow the hooked ends 310 of the engaging members 31 to be movable to and from therein along the insertion direction. This allows the driver means 3 to be retained on the casing 1 in a moveable Manner for driving the FPC into the interior chamber 11.

Figure 4:
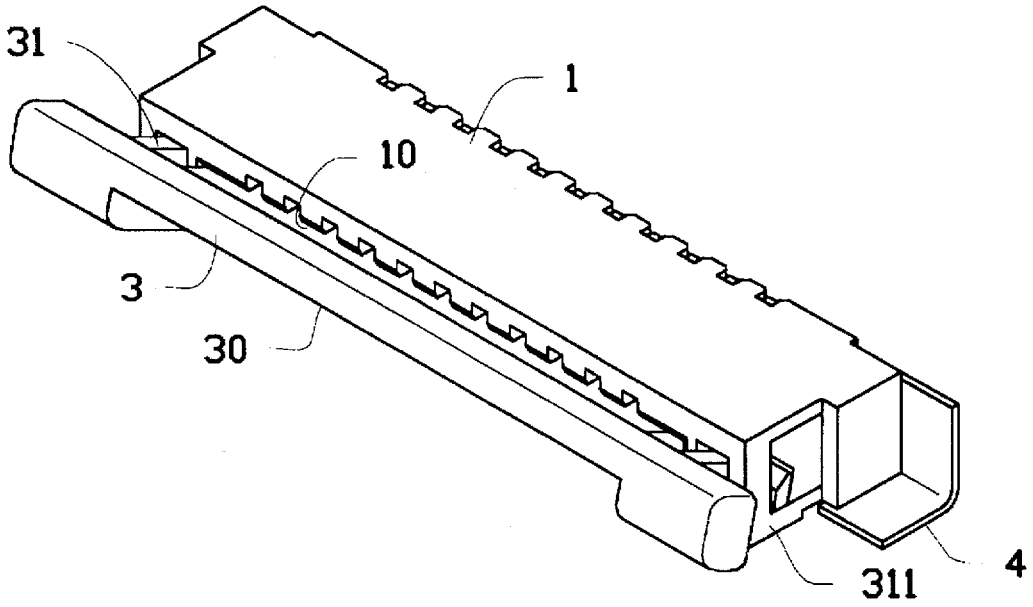
FIG. 4 is a perspective view similar to FIG. 2, showing an electrical connector constructed in accordance with a second embodiment of the present invention, which is of a loose engagement status and adapted to be used as a lower side horizontal insertion connector.

The hooked end 310 of each of the engaging members 31 is provided with at least one inclination 311 facing one of the longitudinal side walls 110 of the casing 1 to provide tapering for the engaging member 31. The inclinations 311 allow the plate 30 of the driver means 3 to be oriented inclined relative to the casing 1, as shown in FIG. 4 to form a sufficiently large gap between the plate 30 and the corresponding side wall 110 for low insertion force of an FPC during the early insertion period.

As shown in FIG. 1A, the external mounting means 4 is generally in a form of plate, preferably made of metal or material of sufficient strength, to be secured to at least one of the longitudinal ends of the casing 1, comprising a first section 40 to be surface-engagingly attached to the rear side of the casing 1, which is preferably substantially plain, and a second section 41 extending from the first section 40 at an angle to be surface-engagingly attached to one of the longitudinal side walls 110, such as the lower one, as shown in FIG. 1A. The plate member of the mounting means 4 further comprises a securing section 42 which is an extension of the first section 40 and bent in such a manner to be received within a slit (not shown) formed on the rear side of the casing 1 when the first section 40 is attached to the rear side of the casing 1. The securing section 42 may be provided with side barbs 421 to engage such slit and thus more securely retain the mounting means 4 onto the casing 1.

In the first embodiment illustrated, the first section 40 and the second section 411 are each provided with a hole or slot 401 and 411 to selectively receive the mounting pin 133 of the casing 1 to extending therethrough. For the embodiment illustrated in FIG. 1A, the mounting pin 133 extends in a direction substantially normal to the longitudinal side walls 110 of the casing 1 so as to run through the slot 411. It is however possible for a dwell pin that extends in different direction relative to the casing 1 to run through the hole 401, such as that shown in FIG. 6B in which the mounting pin, which in FIG. 6B is designated with the reference 133' extends substantially along the insertion direction so as to run through the hole 401 of the first section 40 of the external connection means 4.

Figure 2:
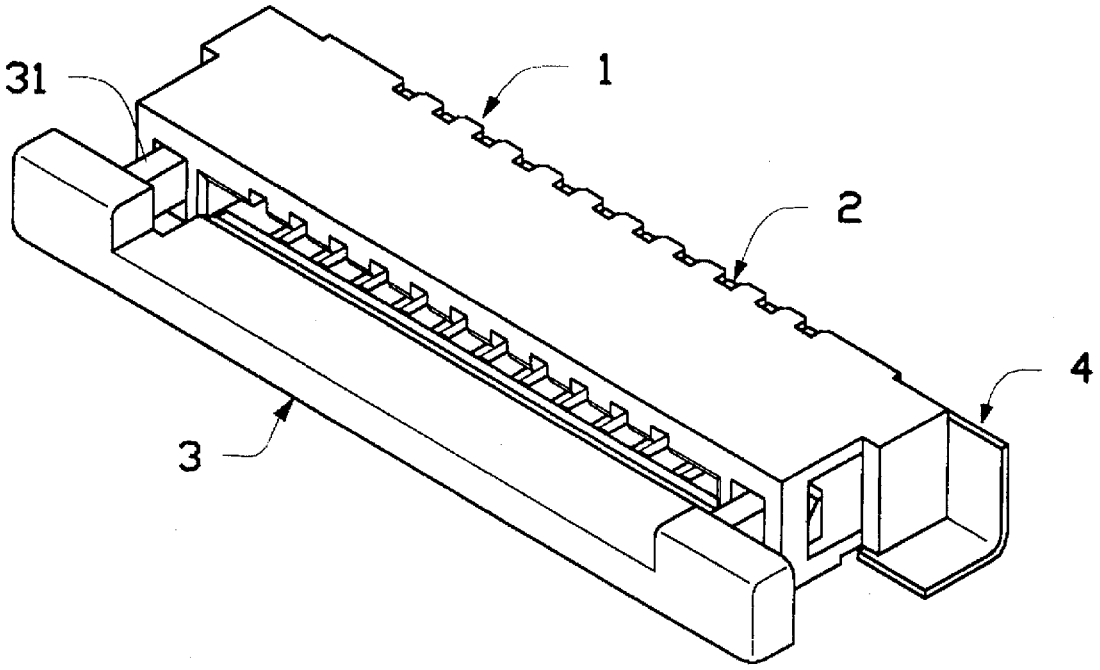
FIG. 2 is a perspective view showing the electrical connector of the first embodiment of the present invention in which the driver member is retained on the casing.

With particular reference to FIGS. 2 and 3, the interior chamber 11 of the casing 1, with the terminal members 2 appropriately received and retained within the slots 12, provides a spacing between the arms 201 and 202 for receiving the FPC which is driven into the spacing by means of the driver 3 and retained between one of the longitudinal side walls 110, for example the upper side as viewed in FIGS. 1A, 2 and 3, and the plate 30 of the driver means 3. The gap left between the plate 30 of the angled driver means 3 and the longitudinal side wall 110 of the casing 1 is large enough to receive and retain the FPC therein without substantial damage to or with lower insertion force of the FPC during the early stage of the insertion period.

To assist the insertion of the FPC into the interior chamber 11 of the casing 1, the driver means 3 is provided with a shallow recession 32 (see FIG. 1A) for passing the FPC. During inserting the FPC into the interior chamber 11, the FPC is placed within the shallow recession 32 with a portion thereof overlapping the plate 30 to be moved into the interior chamber 11 with the plate 30.

Figure 5:
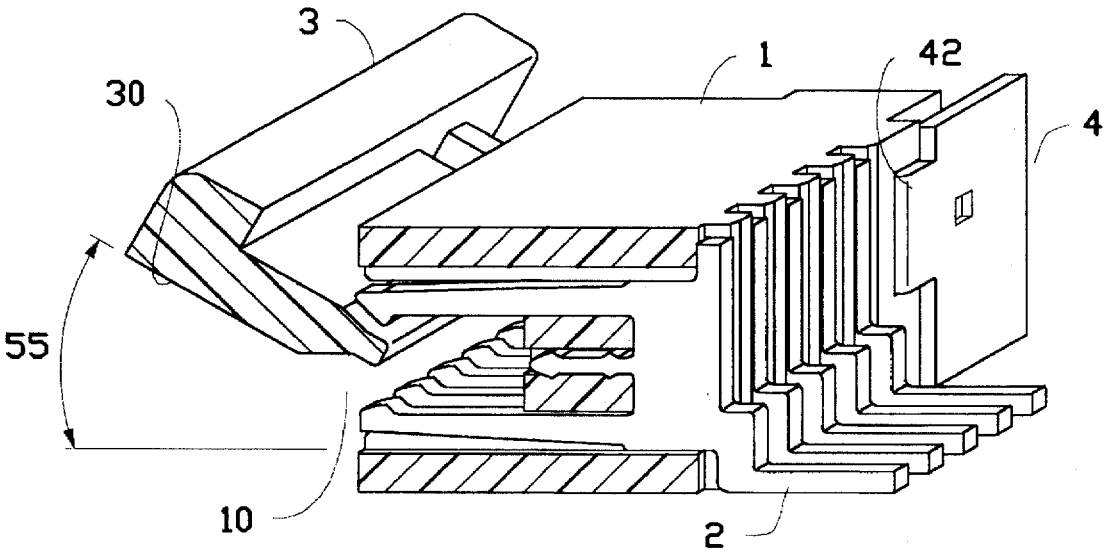
FIG. 5 is a perspective view similar to FIG. 3, showing the electrical connector of the second embodiment of the present invention, with a portion thereof cut off to illustrate the inside structure of the electrical connector.

Referring now to FIGS. 4 and 5, a second embodiment of the electrical connector of in accordance with the present invention, adapted to be used as a lower side horizontal insertion connector, is illustrated, in which the driver means 3 is received within the interior chamber 11 in an "up-side-down" manner, namely the shallow recession 32 that faces the upper longitudinal side wall 110 in FIG. 1A for allowing the FPC to be sandwiched between the upper longitudinal side wall 110 and the plate 30 of the driver means 3 being now orientated to face the lower longitudinal side wall 110 so as to allow the FPC to be retained between the lower longitudinal side wall 110 and the plate 30. The inclinations 311 of the engaging members 31 allow the driver means 3 to be rotated relative to the casing 1 to an inclined position, as shown in FIG. 5, so as to form an increased included angle 55 and a gap between the plate 30 and the lower longitudinal side wall 110 to allow easy entry of the FPC therein. To comply with the angled insertion of driver means, the plate 30 has a pair of tapered surfaces 34 and 35 (FIG. 5) on its bottom section.

With the insertion of the driver means 3 and the FPC into the interior chamber 11, the arms 201 and 202 of the terminal members 2 are forced to elastically bent outward with the assistance of the gaps 5 between the arms 201, 202 and the corresponding side sections of the slots 12 to allow the driver means 3 and the FPC to be moved inward in a less abraded manner. The resiliency of the arms 201 and 202 serve to bias the contact projections 201 and 202 to engage and retain the plate 30 of the driver means 3 and the FPC therebetween so as to secure the driver means 3 and the FPC within the interior chamber 11 of the casing 1. The arms 201 and 202 of the terminal members 2 also serve to form an electrical connection with corresponding terminals formed on the FPC.

Figure 6:
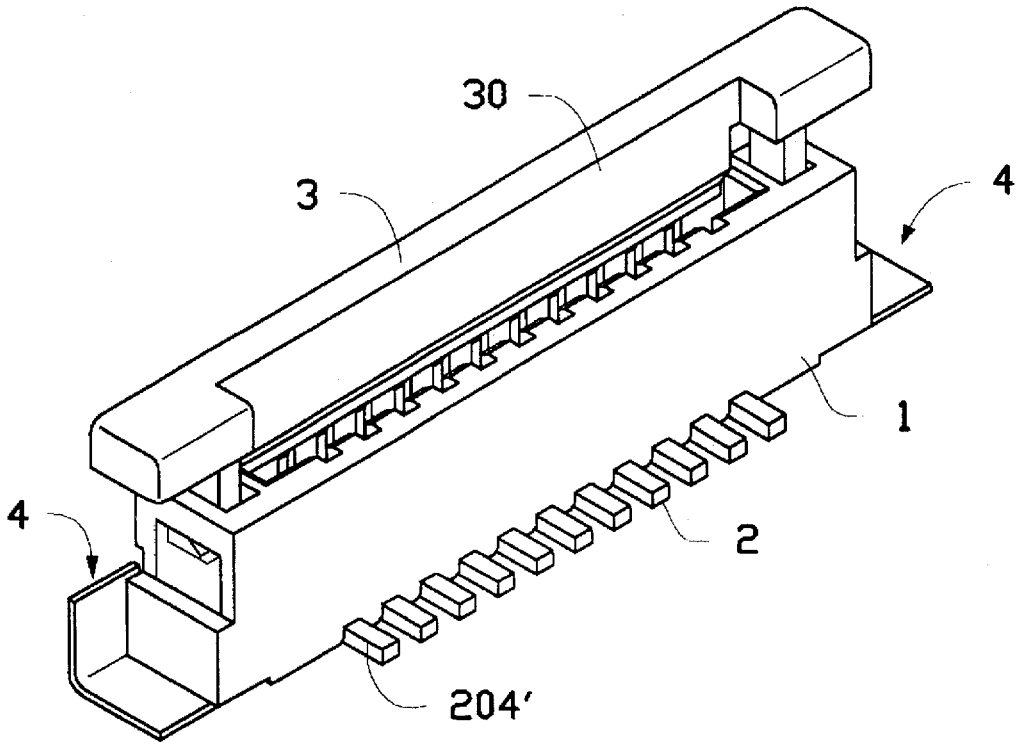
FIG. 6A is a perspective view showing an electrical connector constructed in accordance with a third embodiment of the present invention, which is adapted to be used as a vertical insertion connector.
FIG. 6B is a side view of the electrical connector of FIG. 6A.
Figure 6:
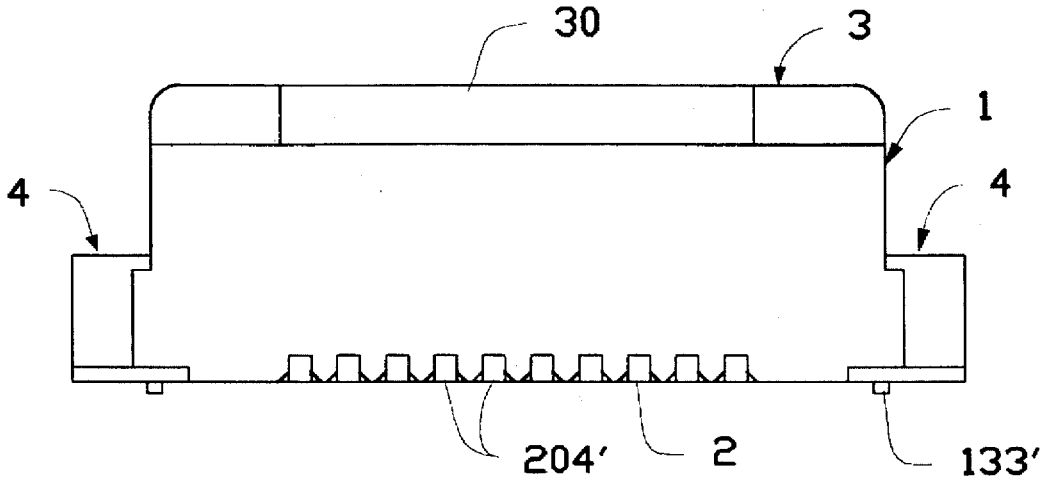
Figure 7:
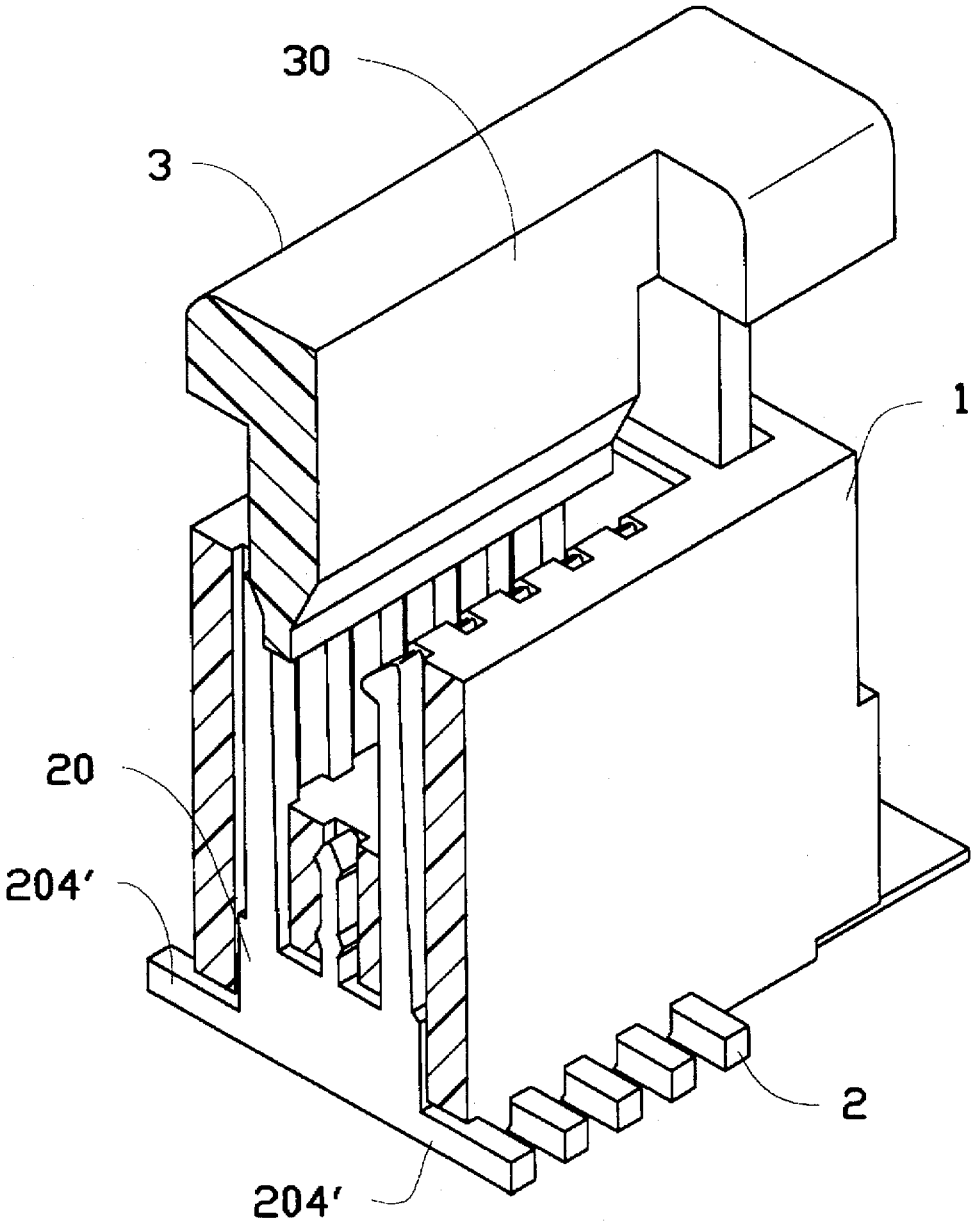
FIG. 7 is a perspective view of the electrical connector of FIGS. 6A and 6B, with a portion thereof cut off to illustrate the inside structure of the electrical connector.

In FIGS. 6A, 6B and 7, a third embodiment of the present invention, adapted to be used as a vertical insertion connector, is illustrated, in which an external contact pin 204' is provided on each of the terminal members 2, similar to the external contact pins 204 shown in FIGS. 1A, 3 and 4, but extending from the base 20 of the terminal member 2 in a direction substantially transverse to the arms 201 and 202. There may be a second contact pin 204' extending from the base 20 along a direction opposite to that of the first contact pin 204', as shown in FIG. 7. The external contact pins 204' provide means for soldering to and establishing an electrical connection with an external device (not shown).

Furthermore, the mounting pin 133' of the embodiment illustrated in FIGS. 6 and 7 extends substantially along the insertion direction.

The operation of the embodiment of the present invention illustrated in FIGS. 6 and 7 is similar to those of FIG. 1A and FIG. 4.

It can be seen from FIGS. 2 and 4 that in the present invention, the driver means 3 is adapted to be received within the chamber 11 in two directions because the terminal member directions has two opposite arms 201 and 202 respectively positioned in two side walls 110 of the casing 1 for selectively engaging the inserted FPC.

It is apparent that although the invention has been described in connection with the preferred embodiments, it is contemplated that those skilled in the art may make changes to the preferred embodiments without departing from the scope of the invention as defined in the appended claims.

What is claimed is:

1. An electrical connector adapted to be used with a flexible printed circuit, comprising:

an insulation casing, having an interior chamber defined by two opposite longitudinal side walls and having an opening formed on a front side of the casing and a bottom formed on an opposite rear side of the casing, a plurality of slots being formed inside the interior chamber, each of said slots having a bottom section extending from the rear side of the casing to partially penetrate into the bottom and a side section defined by a recess formed on each of the longitudinal side walls and extending from the bottom section to the front side of the casing, a central channel being formed on the bottom of the interior chamber to be located between the two side sections and extending from the bottom section to the interior chamber a plurality of conductive terminal members, each comprising a base inserted into the bottom section of each of the slots from the rear side of the casing, and a first arm and a second opposite arm respectively extending from the base substantially along the direction as the base inserted into and defining therebetween a spacing, wherein each of said arms received within the side section of the slot, and each of the arms having an inclined outer edge that faces the corresponding longitudinal side wall to define a first gap therebetween so as to allow the first and second arms to be bent away from each other for defining an increased spacing therebetween, a central arm extending from the base to be received within the central channel and retained therein with retaining means;

driver means, which is retained on the casing by means of retaining means, being inserted movably to the casing from the front side to the rear side of the casing, said driver means comprising a plate movably received within the spacing defined between the arms of the terminal members, and a shallow recession formed on at least one side of said plate for passing the flexible printed circuit, and selectively defining a second gap with the corresponding one of the side walls of the casing for receiving the flexible printed circuit therein;

said connector being characterized in that:

by means that each of that first arm and the second arm is spaced from the corresponding side wall by the first gap, and both of the arms are able to be bent away from each other, the driver means can be inserted into between both of said arms and retained in the casing in two selectable manners of the shallow recession thereof facing respectively either longitudinal side walls of the casing, so that the flexible printed circuit inserted though the shallow recession can contact electrically either the first arm or the second arm of the terminal members.

2. The electrical connector as claimed in claim 1, wherein each of the terminal members has an external contact pin extending from the base thereof to project out of the casing.

3. The electrical connector as claimed in claim 2, wherein the external contact pin extends in a direction substantially opposite to the arms of the terminal member.

4. The electrical connector as claimed in claim 2, wherein the external contact pin extends from the base in a direction substantially transverse to the arms of the terminal member.

5. The electrical connector as claimed in claim 1, wherein each of the arms of each of the terminal members has an inward projection formed on a free end thereof.

6. The electrical connector as claimed in claim 1, wherein the central arm of each of the terminal members has side paws formed thereon to engage the central channel of the casing for retaining each of the terminal members within the respective slot.

7. The electrical connector as claimed in claim 1, wherein the casing has two opposite lateral side walls each having a receiving hole formed on the front side of the casing and extending toward the rear side of the casing and a retaining hole formed on the lateral side and extending in communication with the receiving hole and wherein the retaining means for retaining the driver means on the casing comprises an engaging member corresponding to each of the receiving hole to be received therein, the engaging member having an outward bent free end to engage the retaining hole so as to retain the driver means on the casing, the retaining hole being so dimensioned as to allow the bent free end of the engaging member to be movably relative thereto.

8. The electrical connector as claimed in claim 1, wherein the casing has a dwell pin extending therefrom.

* * * * *